US010105564B2

(12) United States Patent
Garland et al.

(10) Patent No.: US 10,105,564 B2
(45) Date of Patent: Oct. 23, 2018

(54) CHALLENGE COURSE WITH RETURN TRACK

(71) Applicant: Ropes Courses, Inc., Allegan, MI (US)

(72) Inventors: Troy Lee Garland, Allegan, MI (US); James Allen Liggett, Allegan, MI (US)

(73) Assignee: ROPES COURSES, INC., Allegan, MI (US)

( * ) Notice: Subject to any disclaimer, the term of this patent is extended or adjusted under 35 U.S.C. 154(b) by 0 days.

(21) Appl. No.: 14/974,325

(22) Filed: Dec. 18, 2015

(65) Prior Publication Data

US 2017/0173378 A1 Jun. 22, 2017

(51) Int. Cl.

| | |
|---|---|
| ***A63B 4/00*** | (2006.01) |
| ***A63B 7/08*** | (2006.01) |
| ***A63B 9/00*** | (2006.01) |
| ***A63B 7/04*** | (2006.01) |
| ***A62B 35/00*** | (2006.01) |
| ***A63B 17/00*** | (2006.01) |
| *A63B 69/00* | (2006.01) |

(52) U.S. Cl.

CPC ..... *A63B 9/00* (2013.01); *A62B 35/0062* (2013.01); *A63B 4/00* (2013.01); *A63B 7/045* (2013.01); *A63B 17/00* (2013.01); *A63B 7/04* (2013.01); *A63B 69/0048* (2013.01); *A63B 2009/002* (2013.01); *A63B 2009/004* (2013.01)

(58) Field of Classification Search

CPC ..... A63B 9/00; A63B 2009/002; A63B 2009/004; A63B 2009/006; A63B 2009/008

See application file for complete search history.

(56) References Cited

U.S. PATENT DOCUMENTS

| | | | |
|---|---|---|---|
| 249,425 | A | 11/1881 | Walling |
| 291,014 | A | 12/1883 | Isard |
| 301,923 | A | 7/1884 | Reisdorff |
| 304,730 | A | 9/1884 | High |
| 308,444 | A | 11/1884 | Terwilliger |
| 316,969 | A | 5/1885 | High |
| 318,627 | A | 5/1885 | Keller |
| 399,283 | A | 3/1889 | Prittie |
| 1,019,984 | A | 3/1912 | McGee |
| 1,920,774 | A | 8/1933 | Webb |
| 2,365,117 | A | 12/1944 | Stafford et al. |
| 2,478,004 | A | 8/1949 | Newell |
| 2,589,803 | A | 3/1952 | Haley |
| 2,699,199 | A | 1/1955 | Huntington |

(Continued)

FOREIGN PATENT DOCUMENTS

DE 102008006611 B3 6/2009

OTHER PUBLICATIONS

Ropes Courses, Inc., 2010 Product Catalog (published on or about Nov. 1, 2010), 20 pages.

(Continued)

*Primary Examiner* — Joshua Lee

(74) *Attorney, Agent, or Firm* — Polson Intellectual Property Law, PC; Margaret Polson; Christopher Sylvain

(57) ABSTRACT

An apparatus and system whereby a user can move by guidance of a return track on a challenger course. The return track may extend away from the challenge course and overhang its main frame so the user can experience an element outside of the main frame.

12 Claims, 4 Drawing Sheets

(56) References Cited

U.S. PATENT DOCUMENTS 2,812,010 A 11/1957 Abdallah
3,039,401 A 6/1962 Bishop
3,040,678 A 6/1962 McEwen
3,270,441 A 9/1966 Hewes et al.
3,577,930 A 5/1971 Rooklyn
3,860,089 A 1/1975 Huggett
3,875,866 A 4/1975 Mazuyer
4,062,293 A 12/1977 Davis
4,256,098 A 3/1981 Swan et al.
4,267,900 A 5/1981 Yin-Lung
4,401,033 A 8/1983 Gerken
4,464,997 A 8/1984 Dehne
4,592,686 A 6/1986 Andrews
4,705,422 A 11/1987 Tsui et al.
4,737,107 A 4/1988 Bories et al.
4,752,987 A 6/1988 Dreyer et al.
4,845,806 A 7/1989 Hamacher
4,911,426 A 3/1990 Scales
5,156,233 A 10/1992 Olsen et al.
5,271,481 A 12/1993 Rich
5,468,199 A 11/1995 Keeler et al.
5,647,747 A 7/1997 Macri et al.
5,660,113 A 8/1997 Lehotsky
5,667,461 A 9/1997 Hall
5,743,576 A 4/1998 Schron, Jr. et al.
5,885,189 A 3/1999 Lane et al.
5,890,328 A 4/1999 Gleave
5,924,260 A 7/1999 Austin et al.
6,032,993 A 3/2000 Kwon
6,244,991 B1 6/2001 Bingham
6,269,944 B1 8/2001 Taylor
6,315,138 B1 * 11/2001 Dyson ..... A61G 7/1015 104/89
6,374,456 B1 * 4/2002 Fort ..... E05D 15/0613 16/87.6 R
6,443,849 B1 9/2002 Byrd
6,604,605 B2 8/2003 Peterson et al.
6,622,634 B2 9/2003 Cylvick
6,666,773 B1 12/2003 Richardson
6,810,818 B2 11/2004 Petzl et al.
7,175,534 B2 * 2/2007 Liggett ..... A63G 31/02 472/136
7,392,747 B2 7/2008 Ksyk
7,416,054 B2 8/2008 Liggett
7,614,957 B2 11/2009 Lickle
7,966,941 B1 6/2011 Brannan
7,981,004 B2 * 7/2011 Liggett ..... A63B 17/00 482/33
7,992,680 B2 8/2011 Small
8,001,904 B2 8/2011 Maes et al.
8,016,686 B2 9/2011 Liggett et al.
8,066,578 B2 11/2011 Liggett
8,166,885 B2 * 5/2012 Kitchen ..... A63G 1/28 104/189
8,360,937 B2 1/2013 Liggett
8,393,277 B2 3/2013 Johnston et al.
8,752,668 B2 6/2014 Liggett et al.
8,683,925 B2 8/2014 Liggett
8,807,044 B2 8/2014 Liggett et al.
8,893,852 B2 * 11/2014 Liggett ..... A62B 35/0075 104/108
9,120,023 B1 * 9/2015 Burroughs ..... A63G 21/20
2002/0162477 A1 11/2002 Palumbo
2006/0027134 A1 2/2006 Steele et al.
2006/0090960 A1 * 5/2006 Liggett ..... A62B 35/0056 182/36
2006/0252562 A1 * 11/2006 Anderson ..... A63G 21/20 472/32
2007/0191123 A1 * 8/2007 Liggett ..... A63G 31/02 472/15
2009/0014259 A1 1/2009 Cylvick
2009/0078148 A1 3/2009 Cylvick
2009/0255436 A1 10/2009 Buckman
2009/0266267 A1 10/2009 Moss
2010/0078262 A1 4/2010 Townend et al.
2011/0132224 A1 6/2011 Kitchen
2011/0162917 A1 7/2011 Steele et al.
2011/0239895 A1 * 10/2011 Liggett ..... A63G 21/22 104/113
2012/0067246 A1 * 3/2012 Liggett ..... B61B 12/00 104/89
2012/0083350 A1 4/2012 Frankowski et al.
2012/0145498 A1 6/2012 Liston et al.
2013/0118842 A1 5/2013 Lerner
2013/0228092 A1 * 9/2013 Liggett ..... A63B 71/0054 104/140
2013/0239841 A1 9/2013 Boren
2013/0239842 A1 9/2013 Boren et al.
2013/0239843 A1 9/2013 Boren et al.
2015/0141205 A1 * 5/2015 Garland ..... A63B 4/00 482/35
2015/0217783 A1 8/2015 Horihan
2016/0272225 A1 9/2016 Liggett et al.
2016/0319192 A1 11/2016 Horihan
2017/0036123 A1 2/2017 Liggett et al.

OTHER PUBLICATIONS

Ropes Courses, Inc., 2012 Product Catalog (published on or about Nov. 1, 2012), 56 pages.
Ropes Courses, Inc., 2014 Product Catalog (published on or about Nov. 1, 2014), 56 pages.
Ropes Courses, Inc., 2015 Product Catalog (published on or about Feb. 1, 2015), 60 pages.

* cited by examiner

CHALLENGE COURSE WITH RETURN TRACK

PRIORITY CLAIM

None.

FIELD OF THE INVENTION

The invention relates to a system to allow users of a challenge course to have a continuous track by having what is called as a return element or return track. The return track also allows the user to remain secured to a single safety member when moving from one challenge element or obstacle to another, or from one direction to another.

BACKGROUND OF THE INVENTION

Challenge courses are structures that allow a person, or a team to challenge themselves by participating in various events such as walking at elevated heights or climbing. These courses are also used to train military personnel. These courses are also used at recreational parks or other such centers that have go-carts and miniature gulf. It is common for people to wait in line to participate in the challenge course.

Therefore increasing the speed of the flow of participants is an important feature of the challenge courses as well as increasing safety. The participants are usually performing some act at an elevated level between support structures. A harness cable secures the participant to a safety hook or trolley. The safety hook or trolley usually slides along cables or inside a track, substantially oriented horizontally as the participant walks on an "element" or "obstacle" below, whereby the participant is secured to a trolley. Therefore it is also an important feature to retain the harness cable to the trolley as the trolley moves along the main track and return track.

One problem with challenge courses involve the traffic flow of individuals using the course along the track. The cause of many of the flow problems are caused by factors such as many users near each other along the same track of the challenge course. The user may be moving along the track until the user encounters an intersection, which normally allows the user to then go left, right, straight ahead, or backwards.

The return track of a ropes course track may be supported from the side of a steel ropes course structure and presents a path or track that starts from a column, runs out around some obstacle and then returns to the same column from which it started. The return track can be supported from the overhead, the platform, another supporting member from another level, or any combination of the three.

The return track presents the opportunity to offer more elements that hang from the side of a steel structure, where normal elements that must be supported at each end, are not possible.

Ropes courses of a modular design like many designs have empty connection points where previously they could only be blocked off. With a return track these empty connection points can be put to good use.

The present invention may only need to connect to one column. If there is one available connection point, a return track can be installed. This will allow customers to add elements where they couldn't before.

The return track can leave from one empty connection point to another on the same column, or leave and return to the same connection point. This configuration can also offer another way for participants to pass each other.

There exists a need for a return tracks and any associated element to be used as respite areas where participants can get out of the main traffic of the ropes course for a short period of time.

There exists a need offer additional ways for participants to pass each other.

There also exists a need to for a return track that can offer the feeling of danger by allowing the participant to distance themselves from the main structure of the ropes course.

Multiple embodiments of the system are disclosed herein. It will be understood that other objects and purposes of the invention, and variations thereof, will be apparent upon reading the following specification and inspecting the accompanying drawings.

SUMMARY OF THE INVENTION

One aspect of the present invention is a continuous track, comprising: a frame having a main track; said main track adapted to receive a trolley; and said main track operably connected to a return track, whereby said trolley can displace within said main track to said return track and from said return track to said main track.

Another aspect of the present invention is a continuous track, comprising: a frame having a main track; said main track adapted to receive a trolley; and said main track operably connected to a return track, whereby said trolley can displace within said main track to said return track and from said return track to said main track; an intersection an element fixedly disposed to said frame; wherein said main track and said return track have a track slot adapted to receive at least one of either a trolley, or anything connected to said trolley; wherein said element is at least one if either ropes that can be walked on, beams, a climbing wall, a bar that requires users to use hands to move along the element, horizontal or angled platforms or steps, horizontally strung cables, ropes, boards and other materials secured between columns or other elements, a free-fall simulation device which allows participants to safely fall, a walk the plank element, a 6-inch stand-alone beam, allowing participants to walk a distance of 7-feet and turn-around hands-free, a rope that can be pulled so participants take their own picture by pulling a rope, or a bench swing element.

A third aspect of the current invention is a challenge course with a continuous track, comprising: a return track; said return track capable of movably receiving a trolley that can move within said return track.

These and other features, aspects and advantages of the present invention will become better understood with reference to the following drawings, description and claims.

DETAILED DESCRIPTION

Reference Numerals

Figure 1:
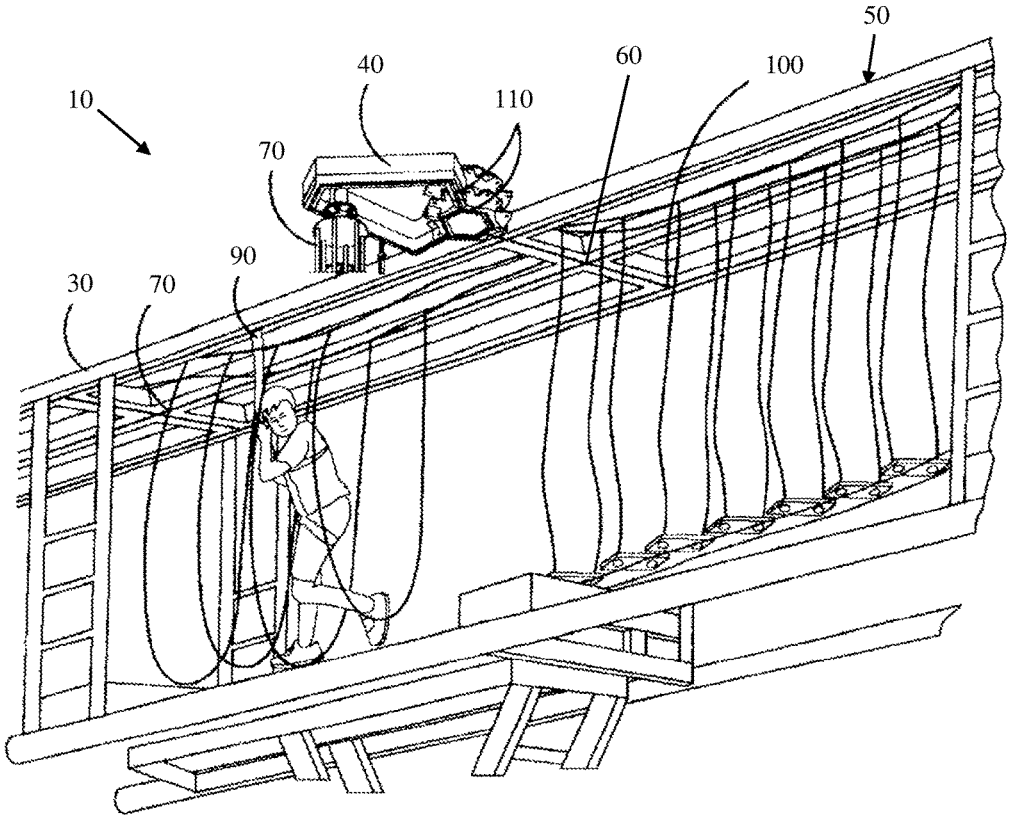
FIG. 1 is a pictorial view of one embodiment of the present invention.

10 challenge course
20 column

30 main track
40 return track
50 frame
60 intersection
70 element
80 trolley
90 safety cable
100 non-returnable intersection
110 track slot
120 hub track
130 distal portion of return track Certain terminology will be used in the following description for convenience and reference only, and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the system and designated parts. Said terminology will include the words specifically mentioned, derivatives, and similar words.

Referring to FIG. 1, a challenge course 10 is illustrated with both the standard intersections 60, non-returnable intersections 100, a main track 30 and a return track 40. The main track 30 and return track 40 may be integrated and connected so a trolley 80 can move from the main track 30 to the return track 40, and from the return track 40 to the main track 30. An element 70 or obstacle 70 may be configured so that a person connected to the trolley 80 or otherwise using the challenge course may walk or interact with the element 70 or obstacle 70.

Figure 2:
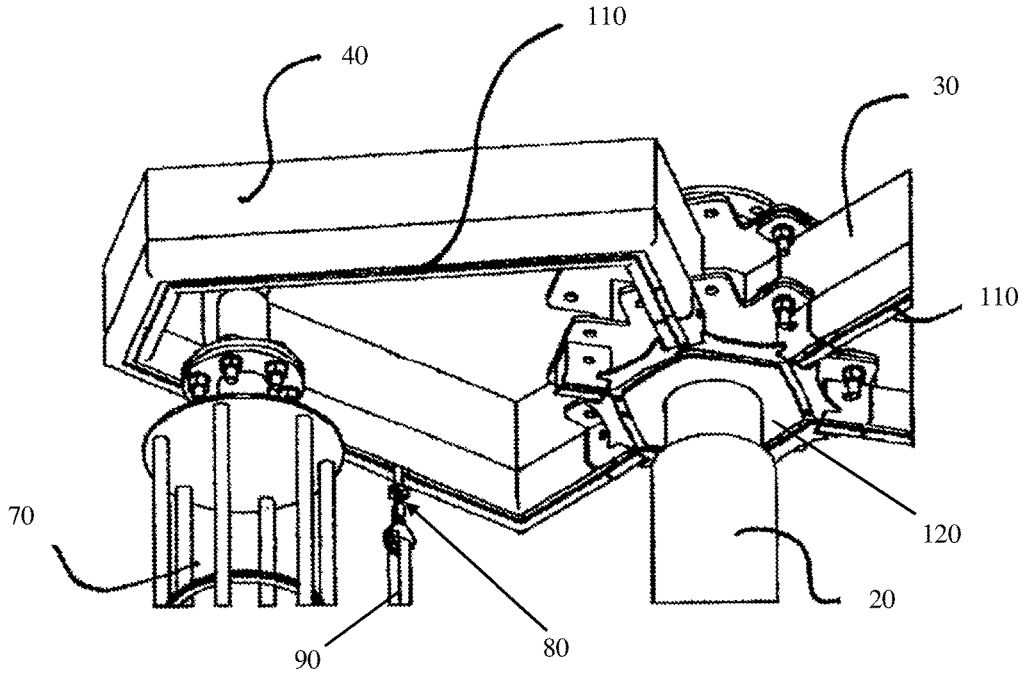
FIG. 2 is a pictorial view of another embodiment of the present invention.

FIG. 2 illustrates an embodiment as to how a return track 40 of the present invention may be configured. In FIG. 1 the return track 40 is illustrated as substantially circular. However, in FIG. 2 the return track 40 has five (5) sides. The main track 30 and return track 40 may have a track slot 110. The trolley 80 may be movably disposed within the main track 30 and return track 40, and may extend downwardly from the main track 30 and the return track 40 through said track slot 110.

The track slot 110 may be contiguous from the main track 30 to the return track 40, and vice versa. An element 70 may be operable by a user when traversing through the return track 40. A column 20 may support a hub track 120. The hub track 120 may have a track slot 110 therein that may also be contiguous or integral with the track slot 110 of both the main track 30 and the return track 40. The hub track 120 may have six (6) sides as illustrated in FIG. 2. However the hub track 120 may also be circular, or any shape or configuration.

Figure 3:
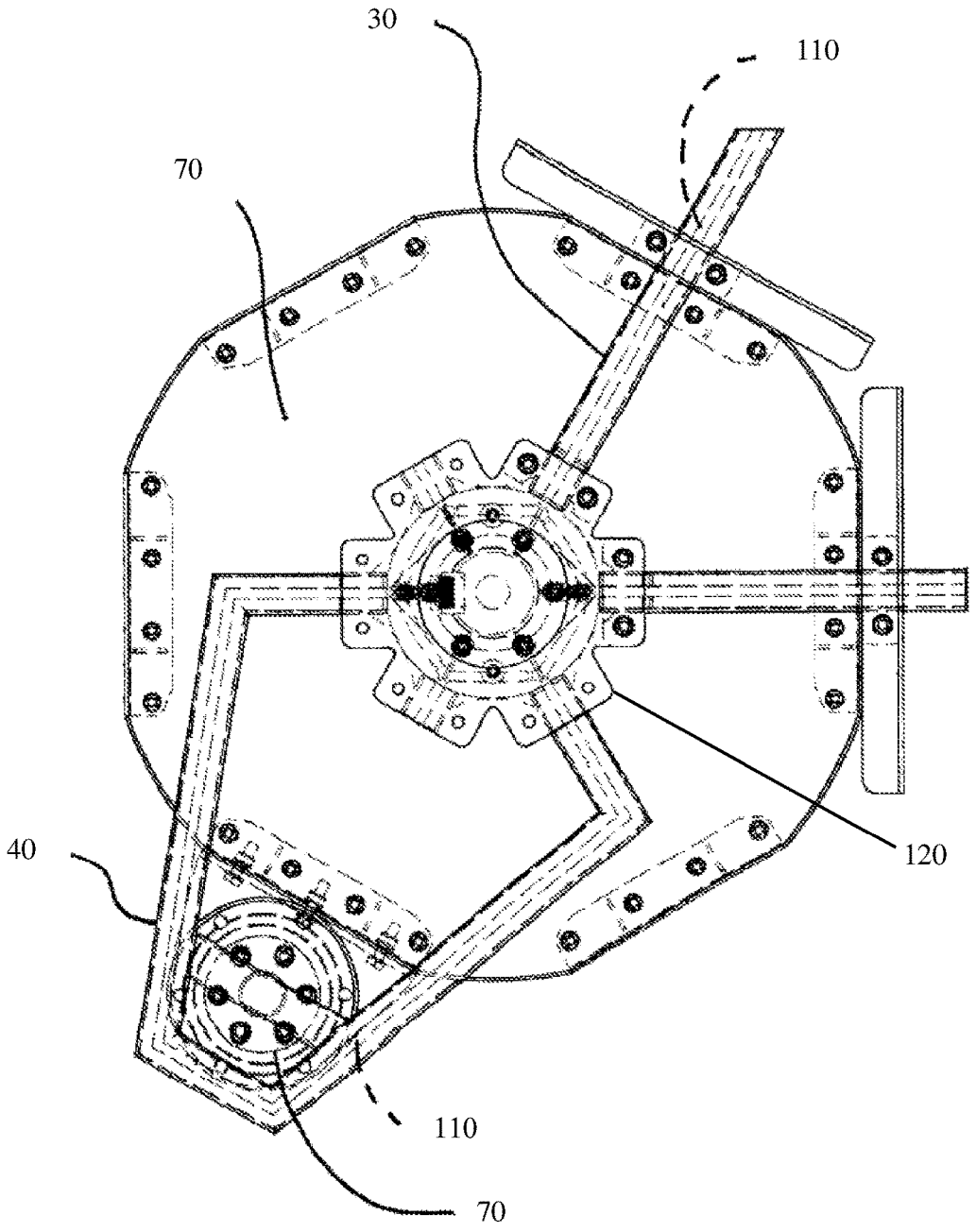
FIG. 3 is a pictorial view of another embodiment of the present invention.

FIG. 3 illustrates an embodiment of a top view from FIG. 2. A main track 30 may be operably connected to a hub track 120, and the hub track 120 may be operably connected to a return track 40. A column 20 may extend from a hub track 120 downwardly to any other portion of a challenge course 10, to the ground, or to an element 70 or obstacle 70.

The track slot 110 may span the entire length and configuration of the main track 30, return track 40, and hub track 120.

Figure 4:
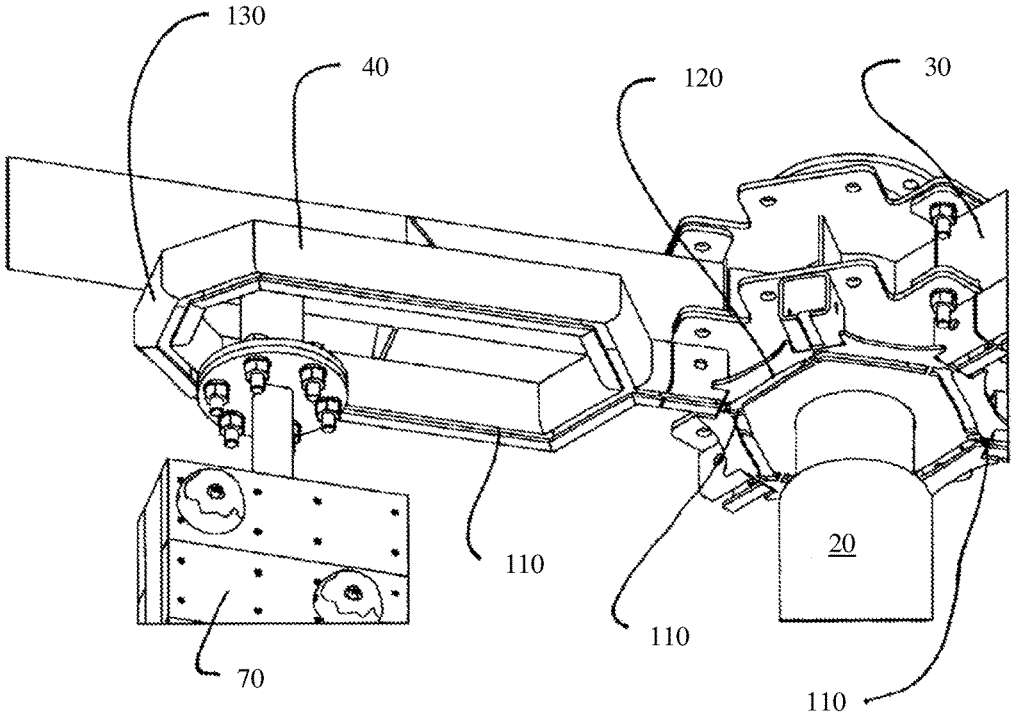
FIG. 4 is a pictorial view of an embodiment of the present invention.

FIG. 4 illustrates another embodiment of a return track 40 of the present invention. The return track 40 may extend away from the challenge course 10. The return track 40 may extend away from a column 20. An element 70 may extend downwardly from the return track 40. The element 70 may allow the user to climb around or upon the element 70.

An element 70 or obstacle 70 is any structure upon which the user may be challenged. Examples of elements 70 or obstacles 70 include but are not limited to ropes that can be walked on, beams, a climbing wall, a bar that requires users to use hands to move along the element, horizontal or angled platforms or steps, horizontally strung cables, ropes, boards and other materials secured between columns 20 or other elements 70, a free-fall simulation device, which allows participants to safely fall, for example, 30-feet from the air, a walk the plank element, a 6-inch stand-alone beam, allowing participants to walk a distance of 7-feet and turn-around hands-free, participants take their own picture by pulling a rope at the end of an element for instant proof of their fearless adventure, or a bench swing element.

Although particular preferred embodiments of the invention have been discussed in detail for illustrative purposes, it will be recognized that variations or modifications of the disclosed apparatus, including the rearrangement of parts, lie within the scope of the present invention.

I claim:

1. A challenge course with one or more obstacles for users to navigate, comprising:

a trolley slideably arranged within a track slot, the trolley having a safety cable extending from the trolley, the safety cable configured to attach to a user during navigation of the challenge course;

the track slot spanning an entire length through a main track, a hub track, and a return track;

the main track positioned above at least one obstacle of the challenge course, the main track connected to the hub track;

the hub track mounted around a support column, the hub track having a plurality of track attachment points facing outward from the support column, the hub track connected to the return track;

the return track extending away from the support column of the hub track, the return track positioned above at least one element that can be navigated.

2. The challenge course of claim 1, wherein the return track comprises a loop.

3. The challenge course of claim 2, wherein the return track is connected to the hub track at a single track attachment point.

4. The challenge course of claim 2, wherein the return track is connected to the hub track at more than one track attachment point.

5. The challenge course of claim 1, wherein the return track comprises a straight segment of track.

6. The challenge course of claim 5, wherein the return track is connected to the hub track at a single track attachment point.

7. A challenge course with one or more obstacles for users to navigate, comprising:

a main track, a hub track, and a return track;

the main track associated with at least one obstacle of the challenge course, the main track connected to the hub track;

the hub track forming a loop and supported by a column positioned at the center of the loop of the hub track, the hub track having a plurality of track attachment points facing outward from the column supporting the hub track, the hub track connected to the return track;

the return track extending away from the column supporting the hub track, the return track associated with at least one element that can be navigated;

wherein a safety hook can displace from the main track to the return track and from the return track to the main track via the hub track, the safety hook having a harness cable for attachment to a user.

8. The challenge course of claim 7, wherein the return track comprises a loop.

9. The challenge course of claim 8, wherein the return track is connected to the hub track at a single track attachment point.

10. The challenge course of claim 8, wherein the return track is connected to the hub track at more than one track attachment point.

11. The challenge course of claim 7, wherein the return track comprises a straight segment of track.

12. The challenge course of claim 11, wherein the return track is connected to the hub track at a single track attachment point.

* * * * *